United States Patent [19]

Hope et al.

[11] 4,135,312

[45] Jan. 23, 1979

[54] FILM DRYER

[76] Inventors: Henry F. Hope; Stephen F. Hope, both of 2421 Wyandotte Rd., Willow Grove, Pa. 19090

[21] Appl. No.: 789,642

[22] Filed: Apr. 21, 1977

[51] Int. Cl.[2] ..... G03D 15/02; F26B 13/00

[52] U.S. Cl. ..... 34/160; 34/155

[58] Field of Search ..... 34/151, 155, 160

[56] References Cited

U.S. PATENT DOCUMENTS

| | | | |
|---|---|---|---|
| 3,186,694 | 6/1965 | Beggs | 34/155 |
| 3,434,225 | 3/1969 | Knibiehly | 34/160 |
| 3,438,140 | 4/1969 | Koehler et al. | 34/160 |
| 3,538,834 | 11/1970 | Yamagata et al. | 34/155 X |
| 3,834,040 | 9/1974 | Russel et al. | 34/160 |

FOREIGN PATENT DOCUMENTS

| | | | |
|---|---|---|---|
| 1279087 | 11/1961 | France | 34/160 |

*Primary Examiner*—Martin P. Schwadron
*Assistant Examiner*—A. Michael Chambers
*Attorney, Agent, or Firm*—Zachary T. Wobensmith, 2nd; Zachary T. Wobensmith, III

[57] ABSTRACT

A film dryer is described which has a central vertical film feeding section for downward movement of the film which is introduced at the top and delivered at the bottom, vertical air delivery sections on each side of the film feeding section, each of the air delivery sections being connected to wind boxes and therefrom to pairs of vertical air delivery ducts and a plurality of spaced horizontal air delivery tubes in groups each carried by a pair of delivery ducts for delivery of air from each side for drying, the tubes preferably being substantially square in cross section and with opposite pairs of corners respectively vertical and horizontal, access openings to the interior of the tubes being provided at each end from the vertical ducts and elongated slots being provided along the inner corners function as self-cleaning nozzles with increased velocity of the air for delivery of air against the faces of the film on each side, a fan or blower at the bottom delivering air to the wind boxes, the air moving outwardly between the tubes and in spaces between the air delivery sections and the housing for recirculation and partial discharge at the bottom.

8 Claims, 6 Drawing Figures

FILM DRYER

FIELD OF THE INVENTION

The invention relates to dryers for film, such as X-ray film, in which a plurality of air streams are directed against opposite side faces of the film as it is advanced through the dryer.

BACKGROUND OF THE INVENTION

It has heretofore been proposed to dry film having a sensitive coating on one side, such as X-ray film, by projecting streams of air thereagainst from a plurality of tubes, circular in cross section, each with a slit therealong for directing the air against the film. The air delivery from tubes of circular cross section, because of the turbulence within the tubes is lacking in uniformity and results in irregular drying with streaking of the film. Dirt also tends to collect in the exit slots of circular tubes and tends to clog parts of the slots resulting in irregular aligning. The manufacture of such circular tubes with uniform elongated slots therealong is difficult to achieve and the resultant tube because of the difficulty of obtaining uniformity also contributes to irregular and non-uniform air delivery against the film faces.

SUMMARY OF THE INVENTION

In accordance with the invention a dryer for film is provided in which the film to be dried is advanced through the dryer housing between air delivery sections, each section having a pair of vertical air delivery ducts carrying spaced horizontal air delivery tubes, preferably square in cross section and with opposite pairs of corners respectively vertical and horizontal, air under pressure being supplied to the tubes at their ends from the ducts for equalization and delivered through slots at the corners facing toward the film, the slots functioning as self cleaning nozzles with increased velocity of the air, the ducts being supplied with air from wind boxes to which the air under pressure is delivered by a fan or blower with recirculation and partial discharge.

It is the principal object of the invention to provide a film dryer in which an improved and more uniform delivery of air is provided for drying the film.

It is a further object of the invention to provide a film dryer in which air delivery tubes of substantially square cross section are employed with a slot along one of the edges for air delivery with a self-cleaning nozzle action and increased air velocity.

It is a further object of the invention to provide a film dryer in which substantial uniformity of air delivery against opposite faces of the film to be dried is effected with elimination of streaking of the film.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which.

Figure 1:
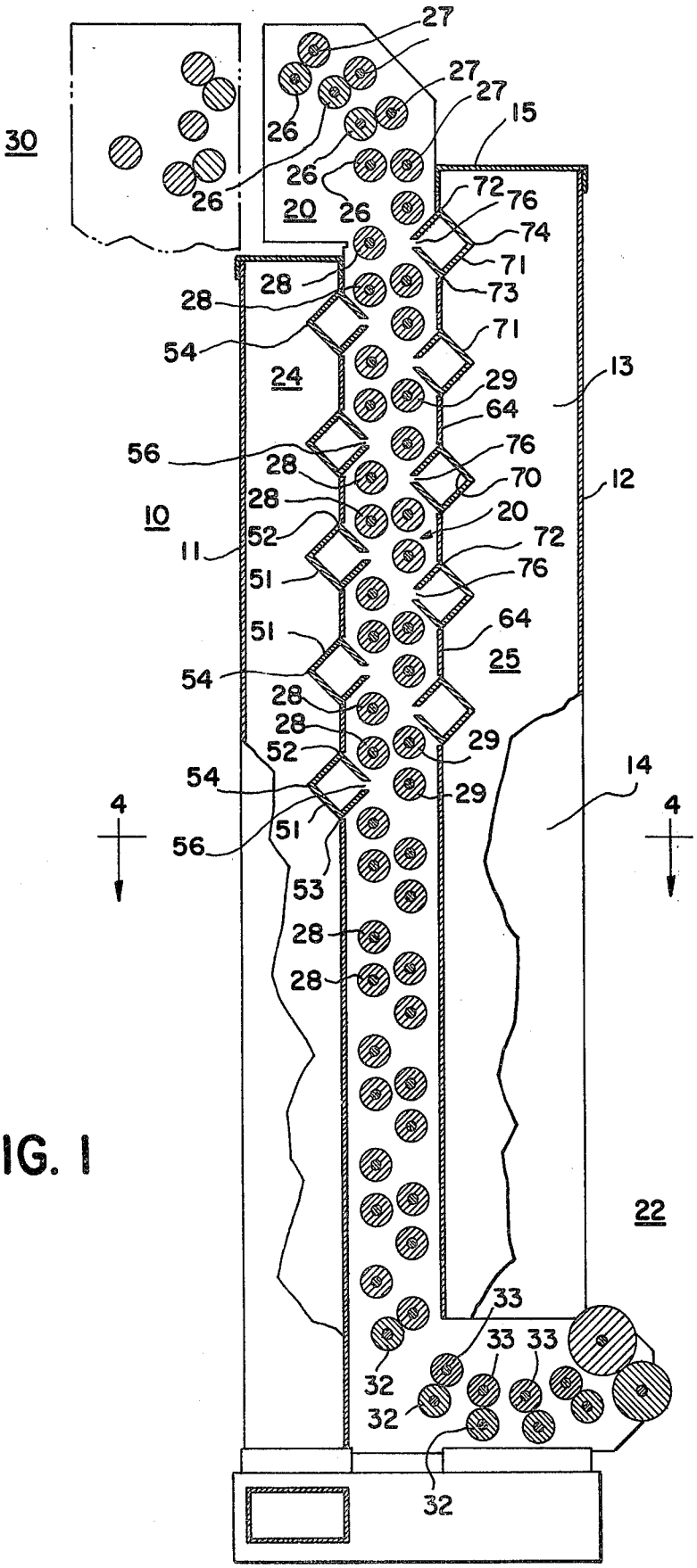
FIG. 1 is a side elevational view as seen from one side of a film dryer in accordance with the invention, parts of the side wall being shown in vertical central section.
Figure 2:
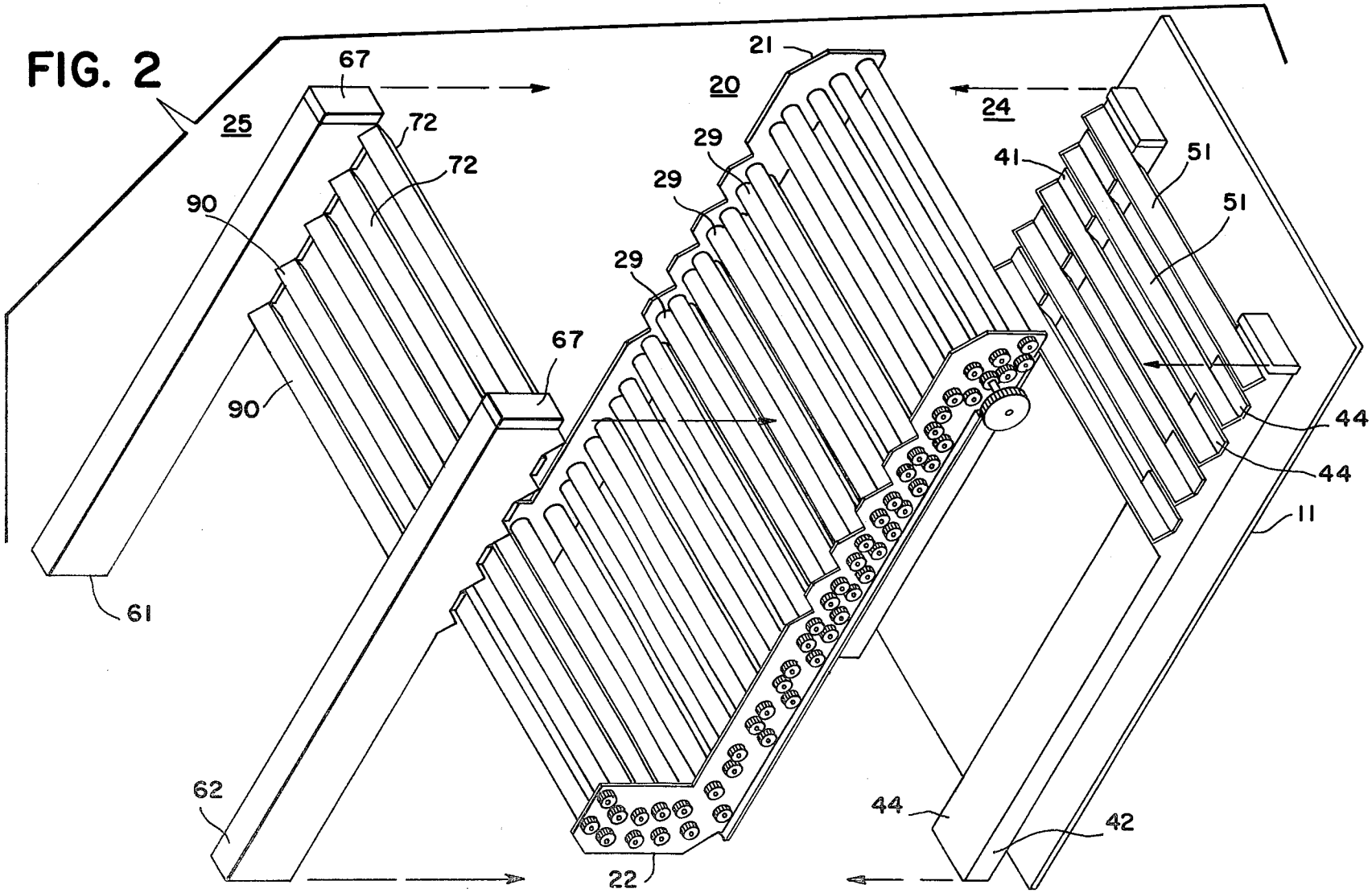
FIG. 2 is an exploded perspective view, as seen from the other side of the upper part of the film dryer shown in FIG. 1.
Figure 3:
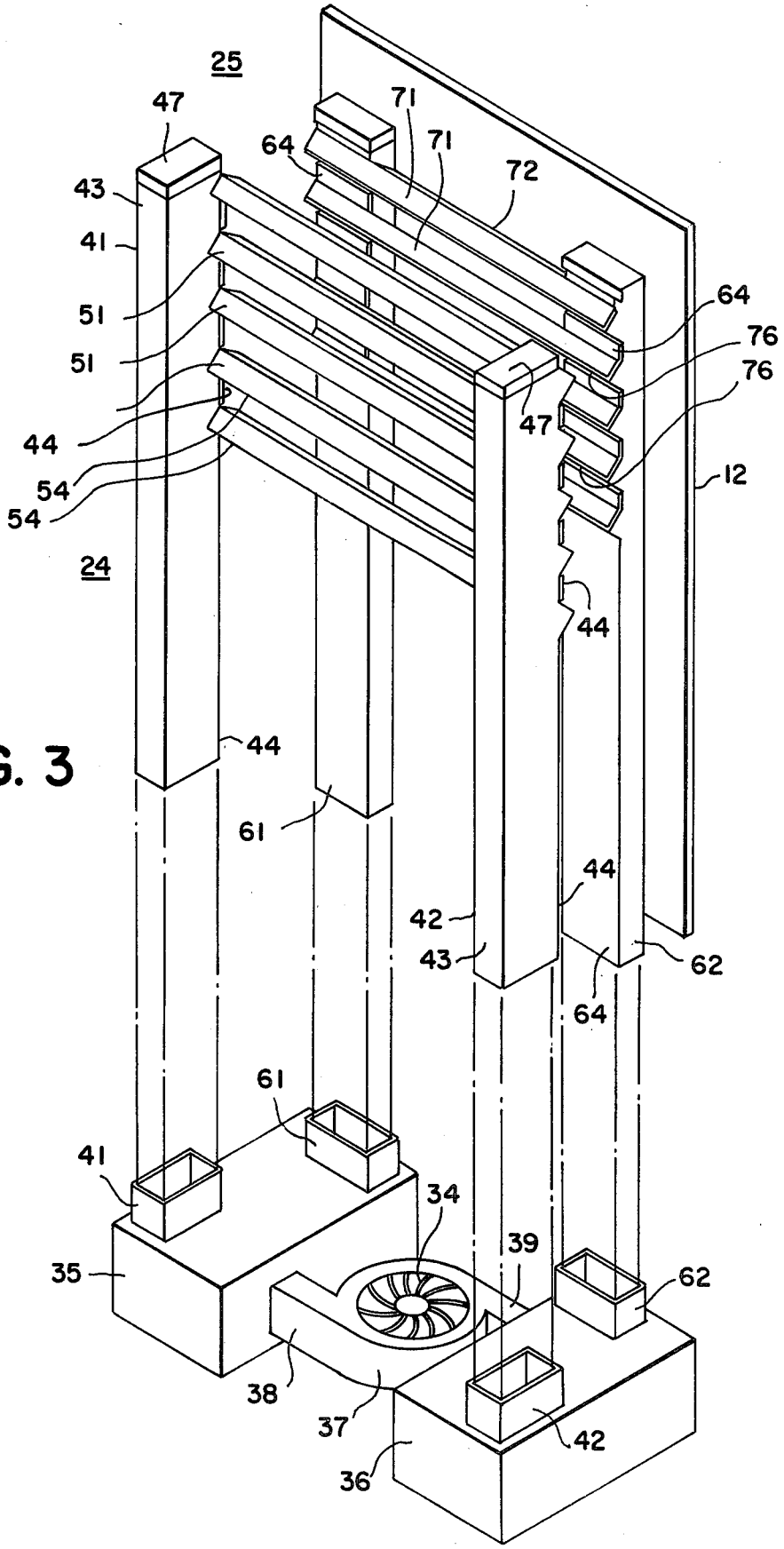
FIG. 3 is an exploded view in perspective of the film dryer of FIG. 1 with the film feeding section omitted.
Figure 4:
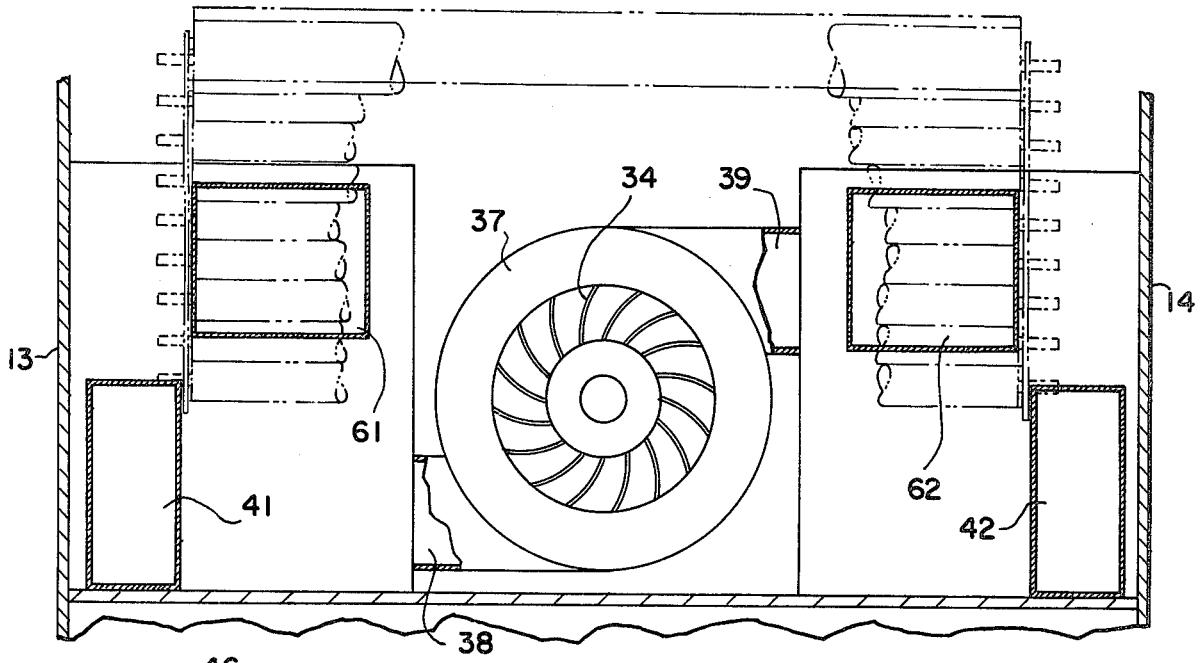
FIG. 4 is a horizontal sectional view taken approximately on the line 4—4 of FIG. 1.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF A PREFERRED EMBODIMENT

Referring now more particularly to the drawings, the film dryer in accordance with the invention preferably includes an outer casing 10 with a vertical front wall 11, vertical rear wall 12, parallel to the front wall, vertical side parallel walls 13 and 14 and a horizontal top wall 15.

Within the outer casing 10 three sections are provided which include a central vertical film feeding section 20 with an upper horizontal entrance portion 21 disposed above the top wall 15 and extending outwardly with respect to the front wall 11, and a discharge or delivery portion 22 extending rearwardly below the lower margin of the rear wall 12.

The three sections also include front and rear air delivery sections 24 and 25.

The entrance portion 21 of the film feeding section 20 is provided with a plurality of pairs of film driving rolls 26 and 27 disposed in an arcuate path from the horizontal to the vertical for receiving film from the discharge end of a film developing or treating machine 30.

The rolls 26 and 27 are preferably driven in opposite directions by gears 31 on one side and by belts (not shown) of well known type on the other side.

Spaced vertical rows of vertically spaced driven rolls 28 and 29 are provided, preferably in pairs for feeding the film to be dried downwardly and for delivery through the delivery portion 22. The rolls 26 and 27 are driven in opposite directions by gears 31 or belts (not shown) of well known type.

The film delivery portion 22 has a plurality of pairs of film driving rolls 32 and 33 disposed in an arcuate path from the vertical to the horizontal for delivery of the dried film to the exterior of the casing 10.

The front air delivery section 24 includes spaced wind boxes 35 and 36, for entrance and exit of air and to which air is supplied under pressure from a fan or blower 37 with an inlet 34 through ducts 38 and 39.

The wind boxes 35 and 36 have extending upwardly therefrom vertical air delivery ducts 41 and 42 of rectangular horizontal cross section. The ducts 41 and 42 have vertical front walls 43, vertical rear walls 44 facing the film feeding section 20, outer vertical side walls 45, inner vertical side walls 46 and top walls 47.

Figure 5:
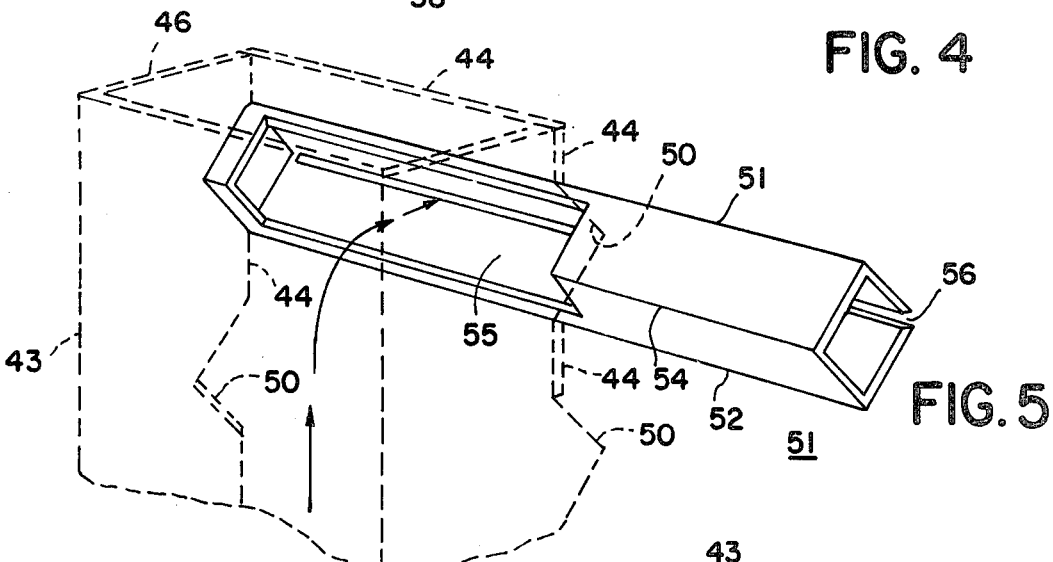
FIG. 5 is a fragmentary view in perspective taken at the end of one of the horizontal air delivery tubes and showing the air access opening for air delivery thereinto.
Figure 6:
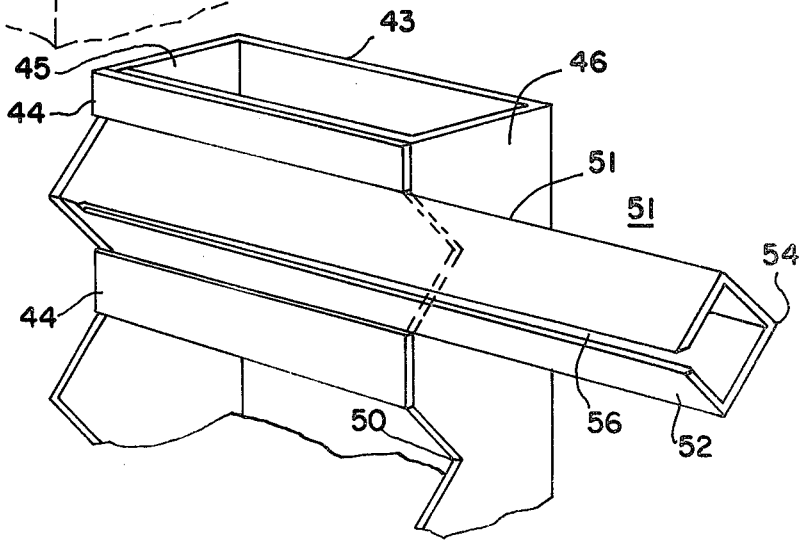
FIG. 6 is a perspective view taken at the end of one of the horizontal air delivery tubes and showing the air delivery slot.

The side walls 46 have V-shaped notches 50 and the rear walls 44 are interrupted for the reception of horizontal air delivery tubes 51. The air delivery tubes 51 are closed at their outer ends and are preferably substantially square in cross section, terminating within the air delivery ducts 41 and 42, with opposite upper and lower corners 52 and 53 vertically disposed, the other corners, including an outer corner 54 being in a horizontal plane and in a notch 50. The air delivery tubes 51, within the ducts 41 and 42 have portions of their walls extending from the corner 54 cut away as at 55 (see FIG. 5) for entrance of air thereinto. The corner opposite the corner 54 is provided with an elongated slot 56 with parallel upper and lower walls for delivery of air with increased velocity from the interiors of each of the air delivery tubes 51 against the film as it is advanced.

The tubes 51 are preferably disposed between pairs of rolls 28 and opposite pairs of the rolls 29.

The rear air delivery section 25 is similar to the front air delivery section 24 and includes, extending upwardly from the wind boxes 35 and 36, vertical air delivery ducts 61 and 62 of rectangular horizontal cross section. The ducts 61 and 62 have vertical rear walls 63, vertical front walls 64 facing the film feeding section, outer vertical side walls 65, inner vertical side walls 66, and top walls 67.

The side walls 66 have V-shaped notches 70 and the front walls 64 are interrupted for the reception of horizontal air delivery tubes 71. The air delivery tubes 71 are similar to the air delivery tubes 51, are preferably square in cross section, terminate within the ducts 61 and 62, and have their upper and lower corners 72 and 73 vertically disposed, have a corner 74 in notches 70, and have elongated slots 76 for air delivery against the film as it is advanced.

The slots 76 are preferably disposed between pairs of rolls 29 and opposite one of the rolls 28.

The mode of operation will now be pointed out.

Film to be dried can be introduced manually but is preferably delivered from a film developing or treating machine 30 between the rolls 26 and 27 by which it is directed downwardly between the rolls 28 and 29 for delivery after drying by the rolls 32 and 33.

Air from the fan or blower 37 enters through the inlet 34 and is delivered through the ducts 38 and 39 to the wind boxes 35 and 36. Air from the wind boxes 35 and 36 moves upwardly through the front air delivery ducts 41 and 42 on each side and enters the air delivery tubes 51 at the openings 55 from both ends of the air delivery tubes 51.

Air from the air delivery tubes 51 passes outwardly through the slots 56 and against the contiguous surface of the film moving downwardly with respect thereto. The air in the tubes 51 moves with less turmoil than with round tubes and is guided and directed by the walls of the air delivery tubes and particularly by the walls which converge toward the slots 56.

Air from the wind boxes 35 and 36 moves upwardly through the rear vertical air delivery ducts 61 and 62 on each side and enters the air delivery tubes 71 at the openings 55 from both ends of the air delivery tubes 71. Air from the air delivery tubes 71 passes outwardly through the slots 76 and against the contiguous surface of the film moving downwardly with respect thereto. The air in the tubes 71 moves with less turmoil than with round tubes and is guided and directed by the walls of the air delivery tubes 71 and particularly by the walls which converge toward the slots 76.

The air, after contact with the faces of the film, moves outwardly between the air delivery tubes 51 and 71, between the ducts 41 and 42 and 61 and 62, and moves downwardly along the spaces within the walls 11 and 12 for passage to the inlet 34 for recirculation and partial discharge and replacement.

The distribution of the air by the air delivery tubes has been found to be effective for preventing streaking and water marking of the film during the drying.

We claim:

1. An air dryer for sheet material and the like comprising a housing, a feeding section within said housing for advancing sheet material therein and having spaced rolls on each side of said sheet material, air delivery sections on each side of said feeding section for delivering air against opposite faces of advancing material, said air delivery sections including spaced air delivery ducts, means for supplying air under pressure to said ducts, and air delivery tubes contiguous to the opposite faces of the sheet material connected at their ends to said air delivery ducts for directly delivering air against said opposite faces of said advancing sheet material.

each of said air delivery tubes having wall portions with inlet openings communicating with said air delivery ducts and having converging wall portions terminating at an air delivery slot disposed inwardly between a pair of rolls in closely spaced relation to and facing said sheet material and directing air substantially normal to the direction of movement of the sheet material.

2. An air dryer as defined in claim 1 in which said air delivery tubes in cross section each has a plurality of corners, and said air delivery ducts have walls with notches in which one of said corners is received.

3. An air dryer as defined in claim 1 in which said air delivery ducts extend from wind boxes to which air is delivered by said air supplying means.

4. An air dryer as defined in claim 1 in which said feeding section is vertically disposed, said air delivery sections are vertically disposed on opposite sides of said feeding section, and said means for supplying air under pressure is disposed at the lower part of said housing.

5. An air dryer as defined in claim 1 in which said air delivery tubes are substantially square in cross section and have one pair of opposite corners horizontally disposed.

6. An air dryer as defined in claim 1 in which said air delivery tubes each has a corner along which said slot extends.

7. An air dryer as defined in claim 1 in which said feeding section has an entrance portion at the upper part of said housing and a delivery portion at the lower part of said housing.

8. An air dryer as defined in claim 1 in which each of said slots has parallel upper and lower margins.

* * * * *